United States Patent [19]

Polverari

[11] Patent Number: 4,791,254

[45] Date of Patent: Dec. 13, 1988

[54] FLOW SWITCH

[75] Inventor: Paul G. Polverari, Branford, Conn.

[73] Assignee: Hydrolevel Company, New Haven, Conn.

[21] Appl. No.: 130,444

[22] Filed: Dec. 9, 1987

[51] Int. Cl.[4] ..... H01H 35/40

[52] U.S. Cl. ..... 200/81.9 M; 73/861.74; 340/610; 200/81 R

[58] Field of Search ..... 73/3, 745, 861.74, 861.75, 73/861.76; 340/610; 335/205; 200/82 E, 81 R, 302.1, 302.2, 81.9 R, 81.9 M; 307/118; 91/1; 92/5 R

[56] References Cited

U.S. PATENT DOCUMENTS 4,168,413 9/1979 Halpine ..... 200/81.9 M
4,614,122 9/1986 Graves ..... 73/861.74

FOREIGN PATENT DOCUMENTS 933555 9/1955 Fed. Rep. of Germany ..... 200/81.9 M
2744901 4/1979 Fed. Rep. of Germany ..... 200/81.9 M

*Primary Examiner*—G. P. Tolin
*Attorney, Agent, or Firm*—Parmelee, Bollinger & Bramblett

[57] ABSTRACT

A switch is responsive to fluid flow within a conduit. It is highly sensitive to variations in flow and forms an effective seal between the fluid and atmosphere. It includes a plastic pivot ball in a spherical seat. A blade extends from the pivot ball into the conduit where it can be displaced by fluid flow to rotate the ball. A lever is eccentrically connected to the pivot ball and extends upwardly within a closed, non-magnetic, housing. The upper end of the lever carries a magnet which actuates a switch outside the housing. An adjustable spring between the top of the lever and the housing permits adjustment of the sensitivity of the response.

11 Claims, 3 Drawing Sheets

FLOW SWITCH

TECHNICAL FIELD

The field of this invention comprises switches which are employed to monitor the flow of a fluid (liquid or gas) through a conduit.

BACKGROUND ART

A conventional device for monitoring the flow of fluid through a conduit employs a blade which extends into the conduit and is subjected to the force of the moving fluid. In one form of prior art device, the actual movement of the blade is limited. An example of such a switch is that described in U.S. Pat. No. 3,729,604 of Groff et al. The larger the conduit, the larger the blade that is employed. Since the blade moves only slightly under the force of the fluid, it tends to flex and, eventually, break. Another disadvantage of such a construction is that sediment contained within the fluid tends to build up due to eddies and turbulence. Another problem arises from the need to seal the switching cavity from the fluid in the conduit. This is commonly accomplished by means of an elastomeric seal or by a metallic bellows. With either approach the sealing device tends to wear out or deteriorate.

Another approach is illustrated in U.S. Pat. No. 3,749,864 of Tice. This patent discloses a construction wherein the blade is movable through a 180° arc. However, movement of the blade is used to cam a spring-loaded member which lifts a magnet into the vicinity of a reed switch. The end result is a substantial amount of friction during the act of camming which reduces the sensitivity of the device. Furthermore, the presence of sharp corners and open cavities tends to induce turbulence and increases sedimentation rates.

The sealing problem is common to all the prior art devices, especially when the fluid being monitored is at high temperatures or pressure or is toxic or corrosive. Accordingly, the objects of the inention are to provide a fluid flow responsive switch which retains a full range of motion of the blade; is usable with a wide variety of monitored fluids; has improved sensitivity to flow variation; minimizes sediment buildup; and has improved sealing qualities intermediate the monitored fluid and the ambient atmosphere.

DISCLOSURE OF INVENTION

The objects of this invention are achieved by means of a construction which employs a novel pivot ball between the measured fluid in the conduit and an enclosed housing for an actuating lever. The pivot ball is mounted in a low friction spherical seat. Leakage into the lever housing is avoided by the combined action of the large area of the seat and pressure within the enclosed lever housing.

BEST MODE FOR CARRYING OUT THE INVENTION

Figure 1:
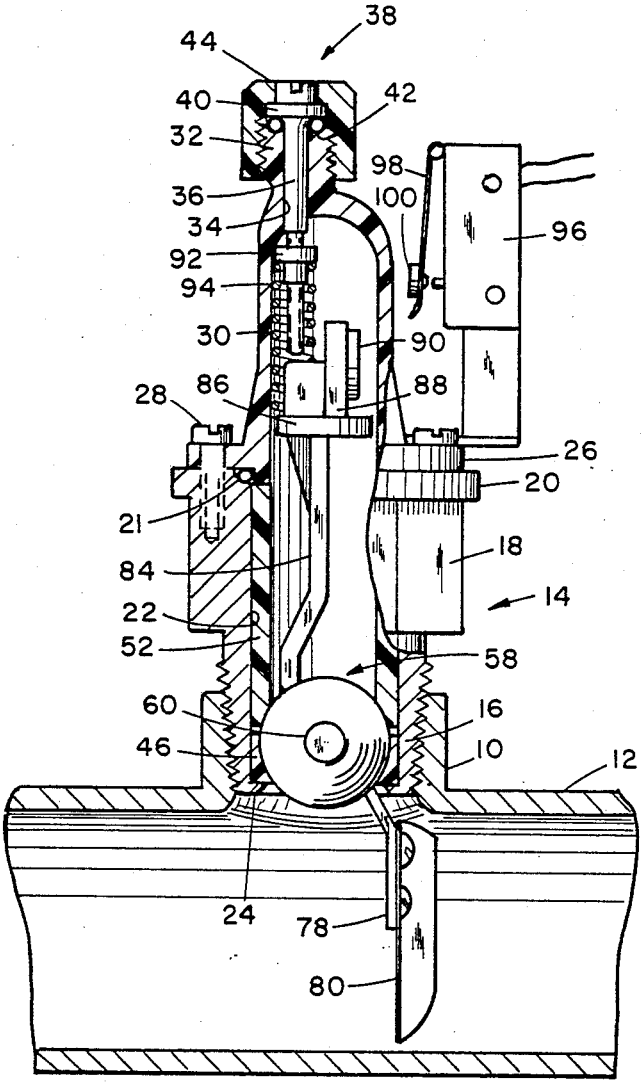
FIG. 1 is an elevational view in partial cross-section of the apparatus of this invention installed in a conduit and in its unactuated position.
Figure 2:
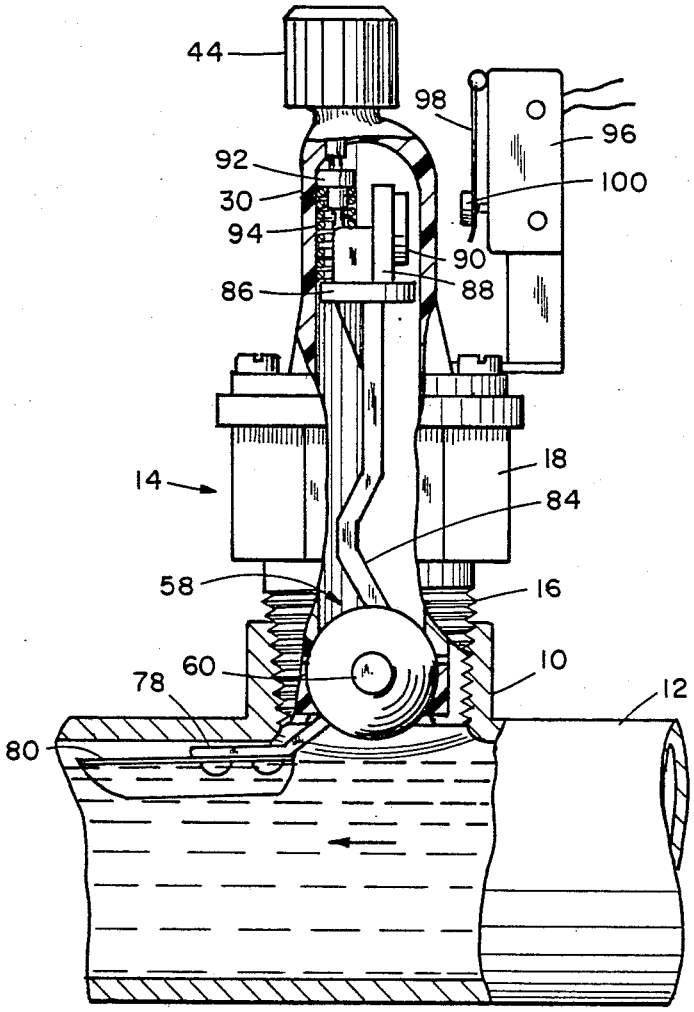
FIG. 2 is a view similar to FIG. 1 illustrating the device in its fully actuated position.
Figure 4:
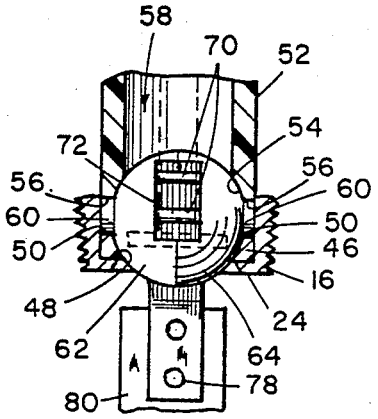
FIG. 4 is a left side view of the device of FIG. 3, in partial cross-section, illustrating the mounting of the pivot ball.

FIG. 1 illustrates the device of this invention installed in a tee 10 of a fluid conduit 12. The device comprises a stainless steel or brass nut 14 having a lower threaded nipple 16, a hexagonal central body 18, and an upper circular flange 20. Extending through the nut 14 is a cylindrical bore 22 which terminates at its lower end at a circular lip 24.

Bolted to the top of flange 20 and against an O-ring seal 21 by means of a mating flange 26 and bolts 28 is a domed plastic housing 30. Atop the housing 30 is a threaded neck 32. The neck 32 defines a bore 34 which extends into the hollow housing 30. The unthreaded shank 36 of a tension adjusting screw 38 extends through the bore 34. A shoulder 40 at the head of screw 38 captures an O-ring 42 which is compressed by a cap 44 screwed onto the neck 32 and having an opening for access to the slotted head of the tension screw 38.

Mounted at the bottom of the bore 22 of nut 14 and resting on the lip 24, is a plastic annular bottom nut liner 46 whose inner surface forms a semi-spherical lower seat 48. The upper rim of bottom liner 46 defines a pair of diametrically opposed semi-circular reliefs 50.

Abutting the upper edge of the bottom nut liner 46 and extending upwardly within the bore 22, is a plastic top nut liner 52. The lower end of top nut liner 52 defines a semi-spherical upper seat 54 which mates with the lower seat 48 on bottom nut liner 46. The lower edge of the top nut liner 52 includes a pair of diametrically opposed semi-circular reliefs 56. A pivot ball 58 rests within the semi-spherical seat formed by the top and bottom nut liners. The ball 58 includes a pair of axle stubs 60 which rotate within the circular openings created by the upper 56 and lower 50 reliefs in the nut liners.

Figure 3:
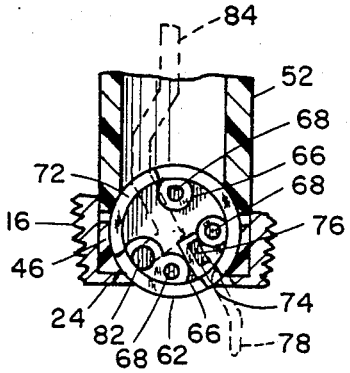
FIG. 3 is a cross-section showing the construction of the pivot ball and seat.
Figure 5:
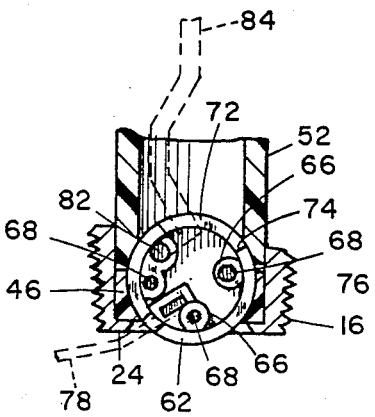
FIG. 5 is an illustration similar to FIG. 3 but showing the pivot ball in its fully actuated position.

The pivot ball 58 is made up of mating halves—a female half 62 and a male half 64. The halves are hollow and may be snap-connected, cemented, or otherwise joined. The female half 62 illustrated in FIG. 3 is molded with three bosses 66 which define assembly holes 68. The male half 64 is molded with assembly pins 70 which fit into the holes 68 upon assembly of the two halves. With this exception, the two halves of pivot ball 58 are identical mirror images. Thus, both halves include mating recesses which form a rectangular opening 72 through the spherical surface. As will be noted in FIG. 3, the opening 72 subtends an arc of approximately 90°. Similarly, the lower portions of the ball halves, as viewed in FIG. 3, are relieved to form a small rectangular slot 74 which is aligned with a rectangular socket 76 on the interior of the ball half. The ligned sockets 76 receive the T-shaped end of a blade support 78 which extends through the slot 74 and is connected to a blade 80. The ball halves also define a pair of aligned pivot openings 82 which receive the lower end of an actuating lever 84.

The actuating lever 84 extends upwardly through the opening 72 in the pivot ball 58 and through the interior of the nut 14 into the housing 30. It is curved so as to permit substantially linear vertical motion of its upper end through 90° rotation of the ball 58. Ball rotation results frmm movement of the blade 80 between the positions illustrated in FIGS. 1 and 2 or 3 and 5. At its upper end the lever 84 includes a small platform 86 and an upright member 88 to which is secured, as by adhesive, a magnetic disk 90.

Screwed onto the lower, threaded, end of the tension screw 38 is a tension nut 92. The nut 92 is positioned against the side of housing 30 which prevents its rotation relative to the housing while permitting vertical movement upon rotation of the screw 38. Connected between the tension nut 92 and the platform 86 at the upper end of lever 84 is a coiled compression spring 94.

Mounted externally of the housing 30 by any suitable means is a microswitch 96. The microswitch 96 includes a switching arm 98 which carries a magnet 100. In the illustrated embodiment, the magnet 100 is of the same polarity as the magnet disk 90 and, accordingly, is repelled by it.

It is believed that the operation of the device of this invention will be apparent from the drawings and the foregoing description. The plastic material of the pivot ball 58 and the top and bottom nut liners forming the spherical seat are selected to be resistant to high temperature and pressure. One suitable material is 30% glass fiber polyether sulfone. The blade 80 is movable through a full 90° so that its movement is directly indicative of flow rather than of pressure exerted by the fluid in the conduit 12. The ball 58 presents a smooth surface to the fluid in the conduit 12, thereby preventing turbulence and helping to avoid sediment deposits which might impede motion. The force required to raise the lever 84 is easily adjustable by rotating tension adjusting screw 38. As the lever rises, magnet 90 contained within the plastic housing 30 will repel the magnet 100 on switching arm 98 to thereby activate an external circuit.

The space above the pivot ball 58 may be dry. The seat for the pivot ball 58 is relatively large in area. This helps to block entry of liquid from the conduit 12 but is not a seal. Furthermore, the pressures within this volume will be substantially equal to the pressure within the conduit 12. In effect, the entire device unctions as a seal in that the presence of the O-rings 21, 42 and the use of magnetic forces through the wall of the closed housing 30 prevent any leakage to atmosphere.

It is believed that the many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

What is claimed is:

1. Apparatus responsive to fluid flow variations within a conduit which comprises:

a housing secured to the conduit about an opening communicating with the interior of the conduit and defining an elongated chamber extending outwardly from said conduit opening in substantially perpendicular relationship to said conduit to terminate at a substantially closed chamber end;

means within said housing for forming a substantially spherical seat adjacent the conduit opening;

a substantially spherical pivot ball rotatably mounted within said spherical seat;

a blade secured to said pivot ball and extending through said opening into said conduit for displacement by fluid flow therethrough to rotate said pivot ball;

a lever having a first end eccentrically secured to said pivot ball and extending through said chamber with a second end positioned within the closed chamber end, whereby said lever is linearly movable along said chamber in response to rotation of said pivot ball; and means responsive to the position of the second end of said lever for indicating a condition of fluid flow within said conduit.

2. The apparatus of claim 1 wherein said condition indicating means comprises a magnet carried by the second end of the lever within said chamber and a magnet sensing means outside of said chamber.

3. The apparatus of claim 2 wherein the closed chamber end is of substantially non-magnetic material.

4. The apparatus of claim 1 wherein said housing is substantially sealed against the ambient atmosphere.

5. The apparatus of claim 1 wherein the spherical seat forming means comprises:

an annular semi-spherical first seat member mounted within said housing, surrounding the conduit opening; and a substantially tubular liner within said chamber having first and second ends, a first end of said liner defining an annular semi-spherical second seat member abutting said first seat member and enclosing said pivot ball therebetween.

6. The apparatus of claim 5 wherein said first and second semi-spherical seat members are plastic.

7. The apparatus of claim 1 wherein said pivot ball comprises:

first and second substantially hemispherical hollow halves defining therebetween (a) means for eccentrically securing the first end of said lever, and (b) a slot in the spherical surface permitting passage of the lever therethrough.

8. The apparatus of claim 1 additionally comprising resilient means interposed between the closed end of said chamber and the second end of said lever.

9. The apparatus of claim 8 wherein said resilient means comprises a spring.

10. The apparatus of claim 9 wherein said resilient means comprises spring force adjusting means.

11. The apparatus of claim 10 wherein the spring force adjusting means comprises a screw.

* * * * *